US011377950B2

(12) United States Patent
Fripp et al.

(10) Patent No.: US 11,377,950 B2
(45) Date of Patent: Jul. 5, 2022

(54) METHOD AND SYSTEM FOR LOCATING SELF-SETTING DISSOLVABLE PLUGS WITHIN A WELLBORE

(71) Applicant: Halliburton Energy Services, Inc., Houston, TX (US)

(72) Inventors: Michael Linley Fripp, Carrollton, TX (US); Andrew Penno, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 58 days.

(21) Appl. No.: 16/882,999

(22) Filed: May 26, 2020

(65) Prior Publication Data

US 2020/0370421 A1 Nov. 26, 2020

Related U.S. Application Data

(60) Provisional application No. 62/852,108, filed on May 23, 2019.

(51) Int. Cl.
*E21B 47/095* (2012.01)
*E21B 47/26* (2012.01)

(52) U.S. Cl.
CPC ..... *E21B 47/095* (2020.05); *E21B 47/26* (2020.05)

(58) Field of Classification Search
CPC ..... E21B 33/134; E21B 43/26; E21B 47/092; E21B 47/095; E21B 47/26
See application file for complete search history.

(56) References Cited

U.S. PATENT DOCUMENTS 3,105,548 A * 10/1963 Ownby ..... E21B 23/02 166/123
5,748,471 A 5/1998 Grande
6,543,280 B2 * 4/2003 Duhon ..... E21B 47/092 73/152.01
7,322,416 B2 1/2008 Burris, II et al.
7,363,967 B2 4/2008 Burris, II et al.
9,328,578 B2 * 5/2016 Kumaran ..... E21B 41/00
9,617,829 B2 * 4/2017 Dale ..... E21B 43/119
(Continued)

FOREIGN PATENT DOCUMENTS

WO 2018067598 A1 4/2018
WO WO-2020251522 A1 * 12/2020 ..... E21B 47/09

OTHER PUBLICATIONS

International Search Report and Written Opin. Issued in Corresponding PCT application No. PCT/US2020/034516, dated Sep. 1, 2020.

*Primary Examiner* — Jennifer H Gay
(74) *Attorney, Agent, or Firm* — Scott Richardson; C. Tumey Law Group PLLC

(57) ABSTRACT

Method and system for deploying a frac package in a wellbore includes providing a location module for the frac package that can determine a position of the frac package in the wellbore. The location module operates to receive beacon signals from beacons located on the wellbore string and to calculate a velocity of the frac package based on the beacon signals. The location module further operates to calculate a location of the frac package based a time since a latest beacon signal and the velocity of the frac package. In some implementations, the beacons includes at least one beacon that transmits or emits a signal and at least one beacon that does not transmit or emit a signal.

20 Claims, 4 Drawing Sheets

(56) References Cited

U.S. PATENT DOCUMENTS 9,903,192 B2 * 2/2018 Entchev ..... E21B 43/263
9,920,621 B2 * 3/2018 Frosell ..... G01V 3/26
10,352,144 B2 * 7/2019 Entchev ..... E21B 43/119
11,125,076 B1 * 9/2021 Zeghlache ..... G01V 3/30
2002/0032529 A1 * 3/2002 Duhon ..... E21B 47/26 702/6
2012/0085538 A1 * 4/2012 Guerrero ..... E21B 43/14 166/284
2013/0062055 A1 * 3/2013 Tolman ..... E21B 43/119 166/250.01
2013/0248174 A1 * 9/2013 Dale ..... E21B 23/00 166/255.1
2013/0255939 A1 * 10/2013 Kumaran ..... E21B 41/00 166/255.1
2014/0076542 A1 3/2014 Whitsitt et al.
2014/0131035 A1 * 5/2014 Entchev ..... E21B 33/1204 166/255.1
2015/0275649 A1 * 10/2015 Orban ..... G01N 27/02 73/152.54
2016/0032712 A1 * 2/2016 Frosell ..... E21B 47/092 324/346
2016/0097259 A1 4/2016 Tolman et al.
2016/0273293 A1 * 9/2016 Surjaatmadja ..... E21B 33/13
2017/0314372 A1 * 11/2017 Tolman ..... E21B 33/134
2018/0135398 A1 * 5/2018 Entchev ..... E21B 33/1204
2018/0245448 A1 * 8/2018 Fripp ..... E21B 47/06
2019/0071963 A1 * 3/2019 Sites ..... E21B 47/26
2019/0085685 A1 * 3/2019 McBride ..... G01V 3/28
2020/0063553 A1 * 2/2020 Zemla ..... E21B 23/10
2020/0080396 A1 * 3/2020 Subbaraman ..... E21B 33/1293
2020/0370421 A1 * 11/2020 Fripp ..... E21B 47/095
2020/0400013 A1 * 12/2020 McBride ..... E21B 43/119
2021/0017855 A1 * 1/2021 McBride ..... E21B 47/09
2021/0032981 A1 * 2/2021 McBride ..... E21B 29/02
2021/0032982 A1 * 2/2021 McBride ..... E21B 41/00
2021/0189865 A1 * 6/2021 McBride ..... E21B 43/117
2021/0238988 A1 * 8/2021 Watkins ..... E21B 23/00
2021/0262332 A1 * 8/2021 O'Malley ..... E21B 33/12
2021/0324728 A1 * 10/2021 Arshad ..... E21B 33/14
2021/0404305 A1 * 12/2021 Winkler ..... E21B 43/27

* cited by examiner

METHOD AND SYSTEM FOR LOCATING SELF-SETTING DISSOLVABLE PLUGS WITHIN A WELLBORE

CROSS-REFERENCE TO RELATED APPLICATIONS

This application claims the benefit of priority to U.S. Provisional Application No. 62/852,108, filed May 23, 2019, the contents of which are incorporated by reference herein.

FIELD OF THE DISCLOSURE

This disclosure relates, in general, to systems and methods of positioning and locating equipment utilized in conjunction with operations performed in relation to hydraulic stimulation and fracturing of subterranean wells and, in particular, to systems and methods for determining operating positions of a frac package or other downhole tool at various points in a wellbore.

BACKGROUND

After drilling each section of a wellbore that traverses one or more hydrocarbon bearing subterranean formations, individual lengths of metal tubulars are typically secured to one another to form a casing string that may be cemented within the wellbore. This casing string provides wellbore stability to counteract the geomechanics of the subterranean formations such as compaction forces, seismic forces and tectonic forces, thereby preventing the collapse of the wellbore wall and provides isolation between sections of the reservoir. To produce fluids into the casing string, hydraulic openings or perforations are typically made through the casing string and extending a distance into the geologic formation.

Hydraulic fracturing or stimulation operations may be conducted in a wellbore including a vertical section extending from a surface location, a transition section and a relatively long horizontal section. Various downhole tools may be positioned in each section of the wellbore to conduct hydraulic fracturing or stimulation operations. These downhole tools may include frac plugs, setting tools, and perforating guns, which may be coupled together on a tool string known as a frac package. Traditionally, frac packages are positioned in the wellbore using a service string or wireline. Positioning frac packages at the proper depth and location along the casing string with wireline and service strings may be challenging and time consuming, particularly in the long horizontal sections where gravity alone may not be relied upon to advance the frac packages.

DESCRIPTION OF ILLUSTRATIVE EMBODIMENTS

Figure 1:
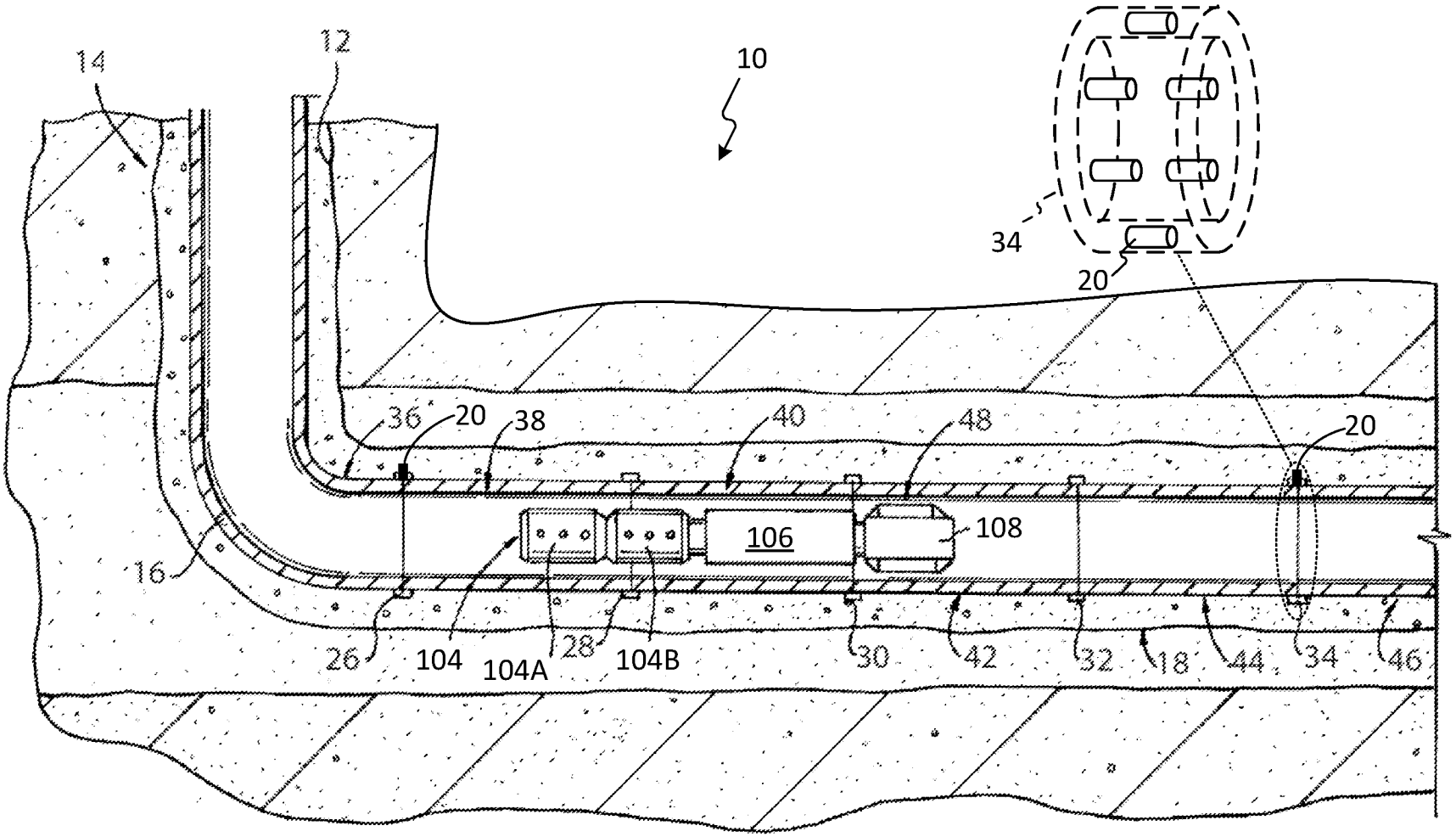
FIG. 1 is a schematic diagram illustrating a wellbore system employing an untethered frac package equipped with a location module according to embodiments of the present disclosure.

While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Illustrative embodiments and related methodologies of the present disclosure are described below in reference to FIGS. 1-4 as they might be employed. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments and configurations thereof may be implemented.

Embodiments of the present disclosure relate to deploying, positioning, and tracking, via various sensing means, an untethered, dissolvable frac package in a casing string for a hydraulic fracturing or stimulation operation. The untethered frac package eliminates a need for coiled tubing, service line, or wireline for downhole placement at a depth of perforating and removal of the frac package. It will be appreciated that although an untethered, dissolvable frac package is discussed herein, embodiments of the present disclosure are equally applicable to any type of well tool known to those skilled in the art, including other types of frac packages.

A typical well 10, as shown in FIG. 1, includes a wellbore 12 in which an untethered dissolvable frac package 48 is deployed according to embodiments of the present disclosure. In the illustrated embodiment, the wellbore 12 extends through various earth strata and has a substantially vertical section 14 and a substantially horizontal section 18. It will be appreciated by those skilled in the art that besides substantially vertical sections and substantially horizontal sections, the wellbore 12 can have other directional configurations, including deviated sections, slanted sections, diagonal sections, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. A casing string 16 can be cemented in both the vertical and horizontal sections of the wellbore 12 or portions thereof.

Difficulties typically arise when transitioning from a vertical section of a wellbore to a horizontal section of a wellbore using a coiled tubing, service string or wireline due to, for example, lack of gravity assistance in conveyance means once the tool reaches a certain distance from the vertical section of the wellbore. In addition, the deployment of a coiled tubing, service line, or wireline to lower the tool leads to rig downtime and added risk and expense. As such, an alternative method of conveyance, such as pumping an untethered frac package along the deviated and horizontal sections of the wellbore would be helpful. Knowledge of the precise location, velocity, and acceleration of the frac package at a given location within the casing string 16 is necessary when positioning the frac package downhole. Determination of a true downhole depth measurement, however, may be difficult due to, for example, inaccuracies in a depth reference log, elongation from thermal effects, buckling, stretching or friction effects, uncertainties in pumped volumes or other unpredictable deformations in the length of casing strings positioned in the wellbore.

Positioning frac packages at the proper depth and location along the casing string 16 using wireline and service strings may be challenging and time consuming, particularly in the long horizontal sections where gravity alone may not be relied upon to advance the frac packages. In some applications, an untethered dissolvable frac package like the frac package 48 can be deployed in the wellbore instead of using wireline and similar conveyance means. However, since the frac package 48 is untethered, other challenges arise in ensuring proper positioning of the frac package.

To address the above difficulties, the casing string 16 is provided with a plurality of couplings 26, 28, 30, 32, 34, one or more of which includes at least one beacon or other detectable markers 20. The beacons or other detectable markers 20 are positioned at predefined or known locations at regular or periodic intervals relative to one another along the casing string, for example, roughly every 40 feet if the beacons are included in the couplings between standard oilfield casings. These beacons or detectable markers 20 can also be mounted on or within the casing string 16 at locations other than the couplings if needed. As a further alternative, the beacons or detectable markers 20 can also be deployed both within the couplings and at locations other than the couplings (i.e., between couplings) if needed.

Then, as the frac package 48 passes by each of the beacons or detectable markers 20, the beacons or detectable markers communicate information to the frac package 48. That is, the frac package 48 receives or detects signals from the beacons or markers 20 that represent, or include, information. The information may be in the form of data, such as an identifier or identifying information of the beacon, or the cardinal coordinates or locations of the beacon 20, for example. The beacon 20 may also be a passive beacon that does not transmit or emit any signals, but can be detected by a suitable detector.

More specifically, a location module 106 provided in the frac package 48 receives or detects the signals from the periodic beacons or detectable markers 20. The location module 106 processes the beacon signals and estimates a velocity the frac package 48 based on elapsed time between signals, which preferably includes the latest beacon signal, and the distance between the beacons or detectable markers 20 using known velocity equations (e.g., velocity=distance traveled/time between signals). From the estimated velocity and the elapsed time since the latest or most recent signal was received, the location module 106 then calculates an estimated position for the frac package 48 relative to the position of the last beacon or detectable marker 20 using known equations. From this relative position information, the location module 106 can determine the location or position of the frac package 48 within the casing string 16, and can then cause the frac package to deploy at certain predefined locations, such as at the setting points for the frac package. Potential setting points are indicated at 36, 38, 40, 42, 44, and 46, which define potential production intervals in the wellbore 12. It is also possible of course to deploy the frac package 48 using only the position thereof relative to the position of the last beacon or detectable marker.

In some embodiments, different couplings can include different types of beacons that send out different signals. For instance, some beacons 20 may emit magnetic field signals, or the signals may be infrared, acoustic or other signal types. One or more beacons may include a unique digital signal, or all beacons may emit the same generic (i.e., no specific pattern, frequency, content, etc.) signal. Alternatively, as mentioned earlier, the beacons may be passive beacons that do not transmit or emit any signals, but can be detected using an appropriate sensor. For example, as discussed later herein, the couplings 26, 28, 30, 32, 34 may serve as passive beacons. Such couplings, or casing collars, provide points of increased mass at regular intervals (e.g., roughly every 40 feet) along the casing string 16 that can be detected by the location module 106 (e.g., via a magnetic detector therein) and used for determining the position of the frac package 48.

In the embodiment of FIG. 1, the frac package 48 includes a perforating gun section 104 at an upper end thereof, which may include one or more perforating guns 104*a*, 104*b*. As depicted, the frac package 48 can be pumped along the horizontal section 18 from a heel end (vertical-horizontal transition) towards a toe end of the wellbore 12. A fluid may be pumped into the wellbore 12 to propel the frac package 48 along the wellbore. Although not expressly shown, in some embodiments the frac package 48 may include radially extending fins to facilitate propelling the frac package by the fluid.

In general operation, the location module 106 uses the timing between signals and the spacing between periodic beacons or detectable markers included with the couplings 26, 28, 30, 32, 34 to estimate a velocity of the frac package. Based on the estimated velocity, the location module 106 can calculate an estimate of the position of the frac package while it is in the spacing between the beacons or detectable markers. To this end, the location module 106 of the frac package 48 is equipped with sensors (FIG. 3) that can sense the signals generated or produced by (or from) the beacons 20 and determine a location of the frac package 48 within the wellbore 12. A setting tool (not expressly shown) within the frac package 48 sets a frac plug 108 at or in proximity to a predetermined setting point based on the determined location. In particular, an actuator instructs the setting tool to move the frac plug 108 from a first radially inward position to a second radially outward position to engage the casing string 16 in response to the position of the frac package matching a predefined location within the wellbore. If the determined location is not adjacent to a beacon 20, the frac package 48 is able to use a calculation of its own velocity (or acceleration in some embodiments) based on the previous beacon signals to deploy the perforating gun at the required location.

The frac package 48 may be autonomous, such that as the package is conveyed into and along the wellbore 12, the location module 106 counts each coupling that the package passes, by detecting the signals produced by each beacon 20 along the casing string 16. Once the location module 106 determines that the frac package has reached a predetermined target depth and/or position along the casing string 16, the perforating guns 104*a*, 104*b* may be instructed to fire and/or the frac plug 108 may be deployed/set. Once the perforating guns have been fired, hydraulic fracturing or stimulation can occur.

In some embodiments, a predefined pattern of beacons 20 is used to identify a unique location along the string 16 in the wellbore 12. Any uniquely identifiable pattern of beacons may be used. A unique pattern of beacons may be defined, for example, by arranging three axially spaced beacons in each of twenty circumferentially spaced rows, and/or by arranging twenty beacons in each of three axially spaced rings, and so forth. Where the beacons are magnetic (e.g., permanent magnets), each of the beacons in the circumferential and axial arrays may be oriented in a predetermined pattern such that the polarity of the magnets produces a uniquely identifiable signature that can be detected by location module 106.

In one embodiment, a first coupling may contain a series of magnetic beacons arranged to produce a specific magnetic field profile, and the location module 106 is preprogrammed to perform a specific action corresponding to a specific sensed magnetic field profile. In another embodiment, the location module 106 may be preprogrammed to perform a plurality of actions corresponding to a plurality of specific sensed magnetic field profiles. In other embodiments, the array of magnetic beacons may be replaced by another type of detectable marker, such as passive radio frequency identification (RFID) tags, or near-field communication (NFC) circuits, and the location module 106 may be equipped with an RFID or NFC interrogator. In some embodiments, radioactive beacons may be employed.

In some embodiments, a combination of the above beacons may be deployed in a casing string. For example, an array of permanent magnets and an RFID tag may be installed in the same casing coupling, or magnets and RFID tags may be installed so as to alternate in a predetermined pattern along the casing string. Similarly, a combination of beacon detectors may be employed for detecting beacons. A single location module 106 may include both a magnetic field detector and an RFID interrogator, for example, or frac packages carrying a single type of depth marker detector may be deployed into the wellbore to alternate in a predetermined pattern.

The use of a combination of types of beacons also provides an advantage in cost savings. For example, the couplings or casing collars 26, 28, 30, 32, 34 may be used as beacons with little or no incremental cost because the collars are already present on the casing string 16. These collars, which are typically made of steel, can be detected using a sensor in the location module 106 that detects changes in a magnetic field. As the frac package travels by the collars, the magnetic field changes due to the additional mass of the collars, which can be detected by the sensor. Casing collar sensors alone, however, tend to be an unreliable means to determine position. But by using higher reliability beacons like permanent magnets, RFID tags, and the like in combination with the casing collars, the lower reliability of casing collar sensors can be compensated to a large extent while at the same time requiring fewer expensive magnets or RFID tags.

Referring still to FIG. 1, in one embodiment, one magnetic beacon 20 may be used in combination with multiple casing collars 26, 28, 30, 32, 34 serving as beacons. In the FIG. 1 example, a magnetic beacon 20 (which may be an array of magnets) is included or installed in casing collar 26, while there are no magnets in the next three casing collars 28, 30, 32, then another magnetic beacon 20 is included or installed in casing collar 34, then no magnets in the next three casing collars, and so on. It will be appreciated that other types of beacons may be used as the beacons 20 besides magnetic beacons. In either case, a cost savings may be realized by having fewer overall beacons 20 along the casing string.

In general operation, the casing collars act as beacons that can be detected by the location module 106 to determine (e.g., calculate) a position of the frac package 48 as it moves along the casing string 16. But as mentioned above, casing collar sensors tend to be unreliable, such that one or more collars may be missed (or falsely counted), especially over a particularly long wellbore. The discrepancy may cause the location module 106 to lose its position reference and incorrectly determine the position of the frac package 48, resulting in the frac package deploying too late (or too early). The magnetic beacons 20, however, provide a solid signal that can be reliably detected by the location module. This allows the magnetic beacons 20 to serve as location reference beacons that let the location module reset or reestablish its position reference (i.e., get back on track positionally). In some embodiments, the reference beacon signals can have a unique signal profile (e.g., pattern, amplitude, frequency, etc.) or otherwise convey identifying information that allows the location module to recognize the reference beacons.

In the foregoing embodiments, it will be appreciated that a different number of casing collars besides 3 may be used in between the reference beacons, such as 5, 10, 20, or 50 collars, and so on. The number of collars in between reference beacons can be fixed (i.e., a periodic reference signal), or the number can vary along the casing string, such that certain sections of the string may have a higher ratio of reference beacons to collars compared to other sections of the string (i.e., an episodic reference signal). It is also possible in some embodiments to have a reference beacon in every collar, or only a single reference beacon for the entire casing string, in which case the reference beacon is typically the first beacon along the casing string.

Figure 2:
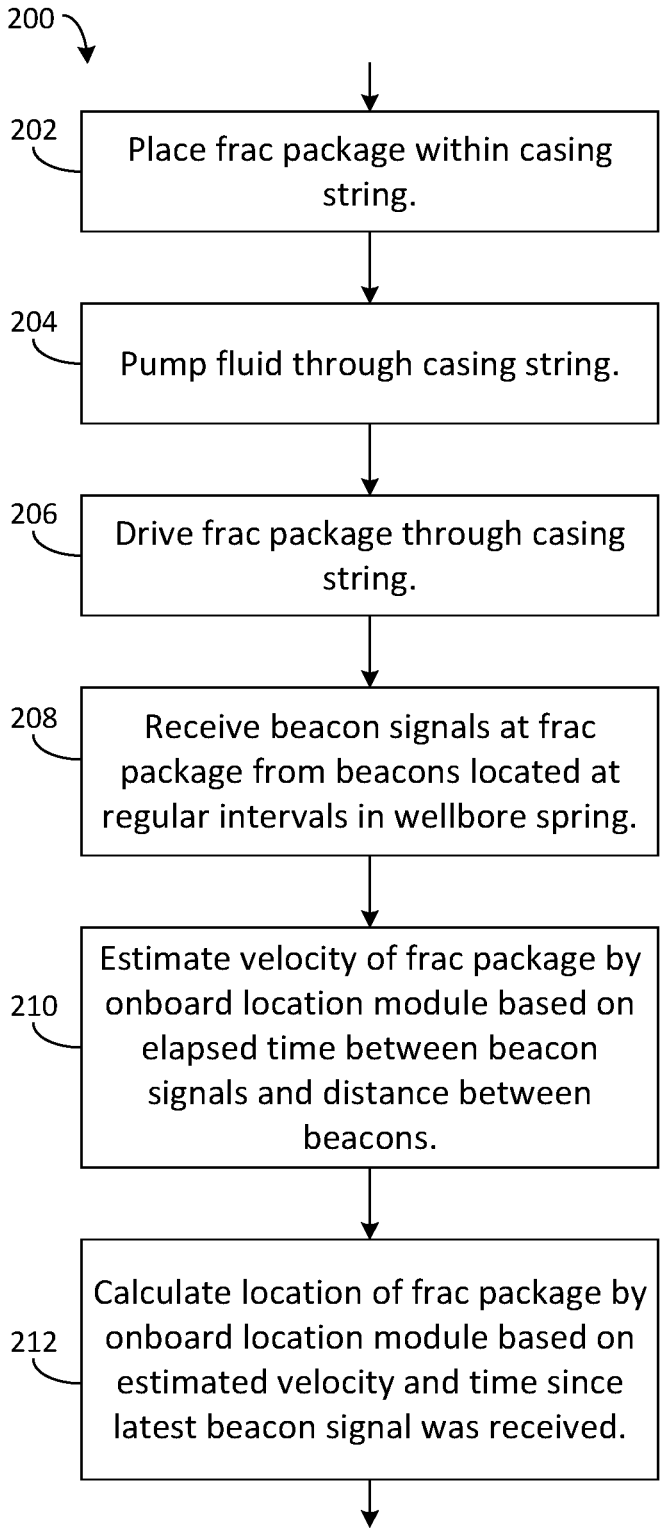
FIG. 2 is a flow diagram illustrating a method of deploying an untethered frac package downhole according to embodiments of the present disclosure.

Turning now to FIG. 2, an exemplary method 200 is shown that may be used to propel and locate the frac package 48 along the wellbore 12 according to embodiments of the present disclosure. In general, exemplary methodologies described herein, such as the method 200, may be implemented by any system having a processor or processing circuitry and/or a computer program product storing instructions which, when executed by at least one processor, causes the processor to perform any of the methodology described herein for calculating a velocity of the frac package 48 by an onboard frac package location module 106. The location module 106 may perform the velocity calculation based on the time since a latest (i.e., most recent) beacon communication was received, and calculating a location of the frac package 48 based on the communicated beacon signal and the calculated velocity. If the desired location is between two beacons, the location module 106 is able to interpolate the location based on a latest communication from a beacon 20.

The method 200 generally begins at 202, where a frac package, such as the frac package 48, is place within the casing string, such as the casing string 16. At 204, fluid is pumped through the casing string and, at 206, the fluid drives or otherwise conveys the frac package through the casing string.

At 208, a location module, such as the location module 106, of the frac package receives or detects beacon signals, such as signals transmitted or emitted by the beacons 20. The signal from the first beacon may be used to establish an initial position reference point for the location module. Subsequent beacon signals may thereafter be used by the location module to calculate an estimate of the velocity of the frac package based on the elapsed time between beacon signals and the distance between beacons, as indicated at 210. Thus, as the frac package passes a second beacon, a signal from the second beacon can be received and processed by the location module to calculate a velocity of the frac package based on the signal from the first beacon, and so on. Preferably, the beacon signals used to obtain the estimated velocity include the latest (i.e., most recent) beacon signal and the elapsed time since the latest beacon signal. The location module can then use the estimated velocity and the time since the latest signal was received to calculate a location or position of the frac package relative to the last beacon in a manner known to those skilled in the art (e.g., distance traveled=velocity×time since last signal), as indicated at 212.

In some embodiments, the location module of the frac package can also include an accelerometer (FIG. 3), which can aid in calculating the change in velocity using acceleration (e.g., velocity=initial velocity+acceleration×elapsed time) and/or direction of the frac package, through either a comparison of the data between multiple beacon data points or by analyzing acoustic vibration of the frac package against the wellbore. The wellbore can include different materials in different sections, which can result in different acoustic signatures. The different materials can include the roughness of the tubing (such as with grooves, diameter changes, indentions, protrusions, or other variations to the surface) as well as the composition of the tubing. The location module can include a program or algorithm to interpret the acceleration based on differing materials and differing location within the wellbore.

After the location module has determined that the frac package has reached the desired location within the wellbore, the frac package may be actuated from a first operating state to a second operating state, or be actuated between various operating states. For example, a frac plug 108 may be actuated from an unset configuration to set configuration. The untethered dissolvable frac packages 48 of the present disclosure may eliminate difficulties in the actuation process for many downhole tools, which may involve tubing movement, tool movement, application of wellbore pressure, application of fluid flow, dropping of balls on sleeves, hydraulic pressure, electronic means or combinations of the above. Following the actuation process, confirmation of the actuation of the downhole tool may be desirable.

Figure 3:
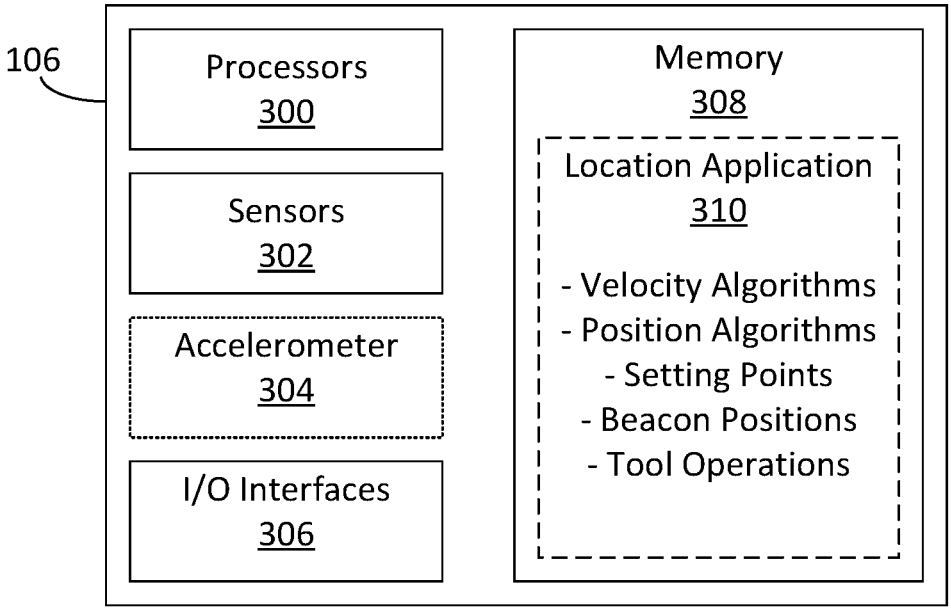
FIG. 3 is a block diagram illustrating a system architecture for the location module according to embodiments of the present disclosure.

FIG. 3 illustrates an exemplary system architecture that may be used for the location module 106 in some embodiments. In this example, the location module 106 is implemented using one or more computer processors 300, one or more sensors 302, an optional accelerometer 304, input/output (I/O) interfaces 306, and a memory 308. In general, the one or more processors 300 execute program instructions for performing various operations in the location module 106, and may be a microprocessor, microcontroller, ASIC, and the like. The one or more sensors 302 operate to receive or otherwise detect signals produced by the beacons 20 and casing collars 26, 28, 30, 32, 34 and may include any sensor known to those skilled in the art that can detect the types of beacon signals discussed herein. The accelerometer 304 measures an acceleration of the location module 106, and the I/O interfaces 306 allows the location module 106 to communicate with the frac package 48 and any equipment thereon, such as a setting tool.

The memory 308 stores software and programming executed by the one or more processors 300 for operating the location module 106. In the example shown, the memory 308 stores a location application 310 that allows the location module 106 to process beacon signals received or detected by the sensors 302, as well as measurements of acceleration by the accelerometer 304 if present. The location application 310 then uses the beacon signals to calculate a velocity and subsequently a location or position of the location module 106. To this end, the location application 310 includes one or more velocity calculation algorithms and location/position calculation algorithms. These algorithms are generally well-known in the art and may include any equations or techniques for calculating velocity and location or position from the perspective of a moving object passing stationary markers. The location application 310 also includes a list or map of preprogrammed or predefined setting points along the casing string 16, and a list or map of beacon locations or positions along the casing string 16. As well, the location application 310 further includes various software and programming for frac package operations, such as setting the frac package, deploying the well tool, and the like.

Figure 4:
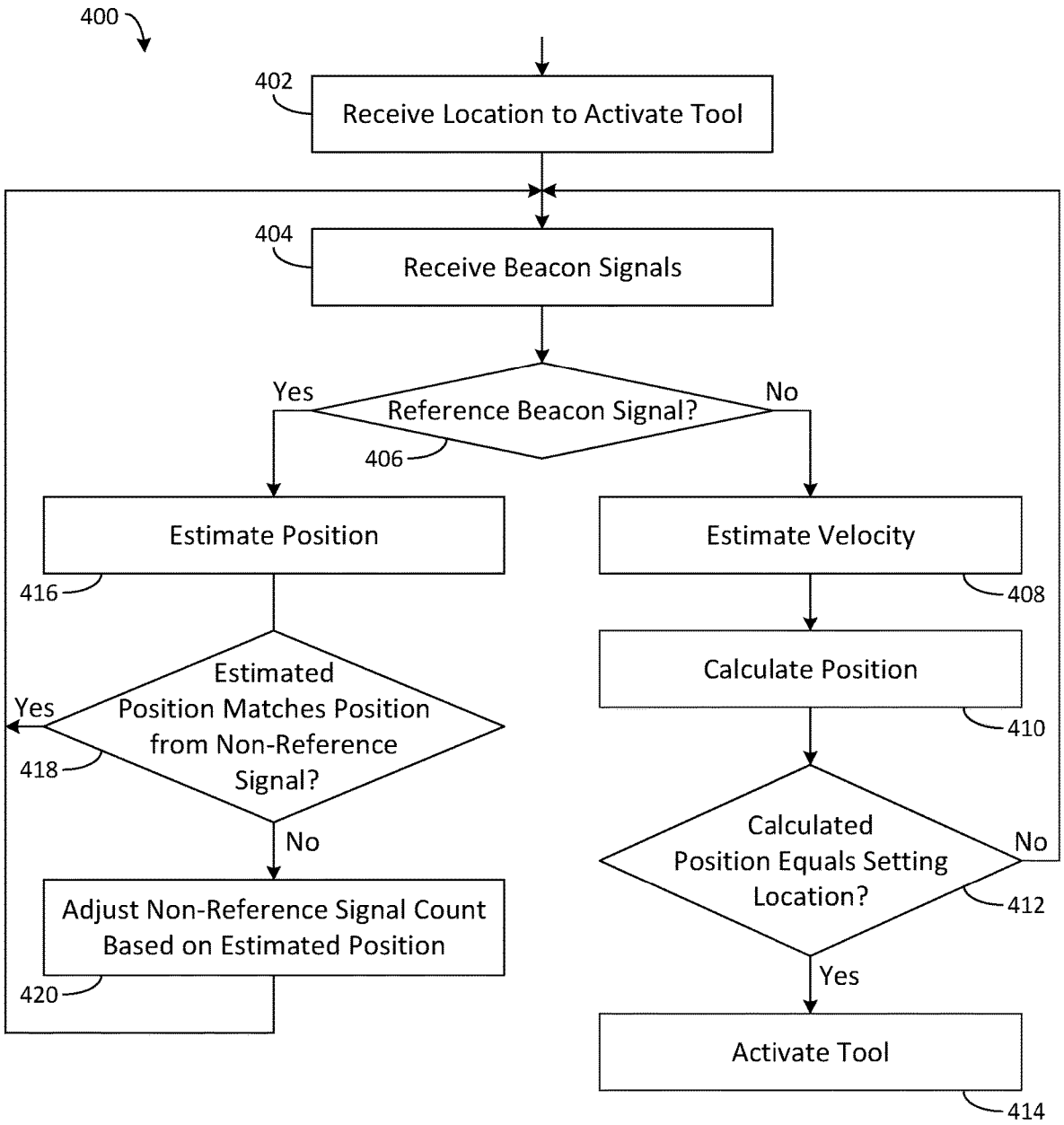
FIG. 4 is a flow diagram illustrating a method of determine a location of a frac package according to embodiments of the present disclosure.

FIG. 4 is a flowchart illustrating an exemplary method 400 that may be used with a location module, such as the location module 106, to calculate a location or position of a frac package, such as the frac package 48, within a wellbore string in some embodiments. The ability to calculate a location or position for the frac package allows the package to be deployed only when its positions (calculated based on velocities derived from beacon signals) equal preprogrammed setting locations.

The method 400 generally begins at 402, where the location module receives the preprogrammed setting location or locations within the wellbore string at which to activate the frac package (or other downhole tools). At 404, the location module receives or otherwise detects a beacon signal. This may be the very first beacon signal detected by the location module, in which case the signal is most likely a reference beacon signal. In any case, at 406, the location module makes a determination whether the beacon signal is a reference beacon signal. In some embodiments, this determination may be made based on whether the signal has a certain profile that establishes the signal as a reference beacon signal. For example, a determination may be made based on whether the signal has a certain amplitude or frequency, or whether the signal has a certain pattern (e.g., via a particular array of magnets), whether the signal contains certain content, such as identification information or coordinate data, and the like.

If the determination at 406 is no, meaning the beacon signal is a non-reference signal, then at 408, the location module estimates a velocity of the frac package using the signal in a manner known to those skilled in the art (e.g., velocity=distance traveled/time between signal detections). At 410, the location module calculates a position of the frac package based on the estimated velocity in a manner known to those skilled in the art. At 412, the location module makes a determination whether the calculated position equals a preprogrammed setting location (or one of the preprogrammed setting locations if there is more than one). If yes, then the location module sets the frac package (or activates the downhole tool) at 414. If the determination at 412 is no, then the location module returns to 404 to continue receiving beacon signals.

If at 406 the received signal is determined to be a reference beacon signal, then at 416, the location module uses the reference beacon signal to estimate a position of the frac package. At 418, the location module makes a determination whether the position estimated at 416 matches or otherwise agrees the position that was estimated at 410. If no, then at 420, the location module adjusts the count of non-reference signals so that the count matches or otherwise reflects the position estimated from the reference beacon signal, since the latter is expected to be more accurate. If yes, then no adjustment is needed, and the location module returns to 404 to continue receiving beacon signals.

In one example, as discussed earlier, the reference beacon signal may be generated or provided by an array of permanent magnets, and the non-reference signals may be generated via the casing collars. The casing collar signals are then used to determine or estimate the velocity and the position of the frac package, and the permanent magnets are used to correct for location errors that might accumulate as a result of casing collar sensor measurements.

Preferably, the position that is used for determining whether to set the frac package may be based on the last two position calculations, the last 3 position calculations, or more. For example, the position used may be an average of the last two position calculations, the last 3 position calculations, or more. In general, multiple measurements may be used to obtain better estimates of the velocity and position of the frac package. For example, multiple measurements may be used to estimate the acceleration of the frac package in addition to velocity, so that changes in the velocity can be estimated. This is useful, for example, when the pump-down efficiency of the frac package changes with different velocities, or when the operator may be slowing the pump-down rate as the frac package is approaching a target setting location.

In some embodiments, the target setting position may be adjusted based on the velocity of the well tool. If the tool is moving quickly, for example, then the inherent time delay of the setting process (i.e., how long it takes to complete the setting process) may be used to adjust the target setting position. At higher speeds, for example, the target setting location may be adjusted to be several feet sooner with the expectation that the actual setting location will coincide with the target location.

In some embodiments, multiple measurements may be used to estimate the acceleration of the frac package in addition to the velocity, so that changes in the velocity can be estimated. This is because the pump-down efficiency of a frac plug can change with different velocities, or the well operator may be slowing the pump-down rate as the plug is approaching the target location.

In some embodiments, the target setting position may be adjusted based on the tool velocity. For example, if the tool is moving quickly, then the time delay of the setting process may be used to adjust the target setting position. At higher speeds, the target setting location may be adjusted to be several feet sooner with the expectation that the actual setting location will match. The setting location may be at a distance between a reference beacon signal and a non-reference signal.

Thus, as described above, embodiments of the present disclosure may be implemented in a number of ways. Embodiments of the present disclosure are particularly useful for deploying an untethered dissolvable frac package 48 and locating a position downhole along the wellbore string. Aspects of the disclosure may also be employed for the orientation and installation of standard completion equipment (e.g., a bridge plug or packer) in a subterranean wellbore, to define the depth that a shifting or positioning tool should become active to interact with a given completion device (e.g., a sleeve or side pocket mandrel), to identify the position of a device in the wellbore for feedback to surface.

Accordingly, in general, in one aspect, embodiments of the present disclosure relate to a method of deploying a well tool in a wellbore. The method comprises, among other things, conveying the well tool through a wellbore string, and receiving beacon signals at the well tool from beacons located on the wellbore string. The method further comprises calculating a velocity of the well tool at an onboard location module of the well tool based on a time between the beacon signals, and calculating a location of the well tool in the wellbore string at the onboard location module based on a time since a latest beacon signal and the velocity of the well tool.

In accordance with any one or more of the foregoing embodiments, the method includes one or more of the following features or attributes: the latest beacon signal includes one of beacon identification information or beacon location information; the beacons include at least one beacon that transmits or emits a signal and at least one beacon that does not transmit or emit a signal; and/or receiving the beacon signals at the well tool includes receiving one of an acoustic vibration produced by the well tool against the wellbore or a magnetic signal.

In accordance with any one or more of the foregoing embodiments, the method further comprises one or more of the following: measuring an acceleration of the well tool and using the acceleration to calculate the location of the well tool; and/or deploying the well tool when the calculated location matches a predetermined location, wherein in some embodiments deploying the well tool includes instructing a setting tool to move the well tool from a first operational state to a second operational state.

In general, in another aspect, embodiments of the present disclosure relate to a system for deploying a frac package in a wellbore. The system comprises, among other things, a wellbore string disposed within the wellbore, the wellbore string including detectable markers along the wellbore string. The system also comprises a frac package deployable through the wellbore string, the frac package including a frac plug and a setting tool operably coupled to the frac plug. The system further comprises a location module housed within the setting tool, the location module configured to detect markers in the wellbore string and determine a velocity of the frac package based on the markers and determine a position of the frac package in the wellbore string based on the velocity. The location module includes an actuator operable to instruct the setting tool to move the frac plug from a first radially inward position to a second radially outward position to engage the wellbore string in response to the position of the frac package matching a predefined location within the wellbore.

In accordance with any one or more of the foregoing embodiments, the system includes one or more of the following features or attributes: the detectable markers include permanent magnets and the location module includes a magnetic field detector; the detectable markers are positioned within couplings on the wellbore string; the location module includes a memory unit having a map stored thereon of detectable marker positions on the wellbore string; the frac package includes an acoustic sensor configured to detect acoustic vibrations on the wellbore string; the detectable marker is a passive marker; and/or the wellbore includes a first coupling having a first material property detectable by the location module and a second coupling having a second material property detectable by the location module.

In general, in yet another aspect, embodiments of the present disclosure relate to a location module for deploying a frac package in a wellbore. The location module comprises, among other things, a sensor configured to detect a beacon on a wellbore string, a processor communicatively coupled to the sensor, and a memory unit communicatively coupled to the processor. The memory unit stores processor-executable instructions that, when executed by the processor, causes the location module to receive beacon signals from beacons located on the wellbore string via the sensor, calculate a velocity of the well tool based on a time between a latest beacon signal and a previous beacon signal, and calculate a location of the well tool in the wellbore string based on a time since the latest beacon signal and the velocity of the well tool.

In accordance with any one or more of the foregoing embodiments, the location module includes one or more of the following features or attributes: the beacon signals include one of beacon identification information or beacon location information; the beacons include at least one beacon that transmits or emits a signal and at least one beacon that does not transmit or emit a signal; and/or the latest beacon signal includes one of an acoustic vibration produced by the well tool against the wellbore or a magnetic signal.

In accordance with any one or more of the foregoing embodiments, the location module further comprises one or more of the following: the processor-executable instructions further cause the location module to measure an acceleration of the well tool and using the acceleration to calculate the location of the well tool; and/or the processor-executable instructions further cause the location module to deploy the well tool when the calculated location matches a predetermined location; wherein in some embodiments deploying the well tool includes instructing a setting tool to move the well tool from a first operational state to a second operational state.

While specific details about the above embodiments have been described, the above hardware and software descriptions are intended merely as example embodiments and are not intended to limit the structure or implementation of the disclosed embodiments. For instance, although many other internal components of the system are not shown, those of ordinary skill in the art will appreciate that such components and their interconnection are well known.

In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the embodiments in the form disclosed. Many modifications and variations will be apparent to those of ordinary skill in the art without departing from the scope of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A method of deploying a well tool in a wellbore, comprising:

conveying the well tool through a wellbore string, the well tool comprising an onboard location module and a dissolvable plug, wherein the onboard location module is adjacent to the dissolvable plug;

receiving beacon signals at the well tool from beacons located on the wellbore string, the beacons including circumferential arrays of permanent magnets;

calculating a velocity of the well tool at the onboard location module, wherein the velocity is calculated with an initial velocity, acceleration, and elapsed time between the beacon signals; and calculating a location of the well tool in the wellbore string at the onboard location module based on a time since a latest beacon signal and the velocity of the well tool.

2. The method of claim 1, wherein the latest beacon signal includes one of beacon identification information or beacon location information.

3. The method of claim 1, wherein the beacons include at least one beacon that transmits or emits a signal and at least one beacon that does not transmit or emit a signal.

4. The method of claim 1, further comprising measuring an acceleration of the well tool and using the acceleration to calculate the location of the well tool.

5. The method of claim 1, wherein receiving the beacon signals at the well tool includes receiving one of an acoustic vibration produced by the well tool against the wellbore, or a magnetic signal.

6. The method of claim 1, further comprising deploying the well tool when the calculated location matches a predetermined location.

7. The method of claim 6, wherein deploying the well tool includes instructing a setting tool to move the well tool from a first operational state to a second operational state.

8. A system for deploying a frac package in a wellbore, comprising:

a wellbore string disposed within the wellbore, the wellbore string including detectable markers along the wellbore string, the detectable markers include circumferential arrays of permanent magnets;

a frac package deployable through the wellbore string, the frac package including, a frac plug and a setting tool operably coupled to the frac plug; and a location module housed within the setting tool, the location module configured to detect one or more of the markers in the wellbore string and determine a velocity of the frac package based on the markers and determine a position of the frac package in the wellbore string based on the velocity, wherein the velocity is determined via an initial velocity, acceleration, and elapsed time between marker signals;

wherein the location module includes an actuator operable to instruct the setting tool to move the frac plug from a first radially inward position to a second radially outward position to engage the wellbore string in response to the position of the frac package matching a predefined location within the wellbore, wherein the location module is adjacent to the frac plug.

9. The system of claim 8, wherein the location module includes a magnetic field detector.

10. The system of claim 8, wherein the detectable markers are positioned within couplings on the wellbore string.

11. The system of claim 10, wherein the detectable marker is a passive marker.

12. The system of claim 10, wherein the wellbore includes a first coupling having a first material property detectable by the location module and a second coupling having a second material property detectable by the location module.

13. The system of claim 8, wherein the location module includes a memory unit having a map stored thereon of detectable marker positions on the wellbore string.

14. The system of claim 8, wherein the frac package includes an acoustic sensor configured to detect acoustic vibrations on the wellbore string.

15. A location module for deploying a well tool in a wellbore, comprising:

a sensor configured to detect beacons that include circumferential arrays of permanent magnets;

a processor communicatively coupled to the sensor; and a memory unit communicatively coupled to the processor, the memory unit storing processor-executable instructions that, when executed by the processor, causes the location module to:

receive beacon signals from the beacons located on the wellbore string via the sensor;

calculate a velocity of the well tool, wherein the velocity is calculated with an initial velocity, acceleration, and elapsed time between the beacon signals; and calculate a location of the well tool in the wellbore string based on a time since the latest beacon signal and the velocity of the well tool, wherein the location module is adjacent to a dissolvable plug.

16. The location module of claim 15, wherein the latest beacon signal includes one of beacon identification information or beacon location information.

17. The location module of claim 15, wherein the beacons include at least one beacon that transmits or emits a signal and at least one beacon that does not transmit or emit a signal.

18. The location module of claim 15, wherein the processor-executable instructions further cause the location module to measure an acceleration of the well tool and to use the acceleration to calculate the location of the well tool.

19. The location module of claim 15, wherein the beacon signals include one of an acoustic vibration produced by the well tool against the wellbore, or a magnetic signal.

20. The location module of claim 15, wherein the processor-executable instructions further cause the location module to deploy the well tool when the calculated location matches a predetermined location, wherein deploying the well tool includes instructing a setting tool to move the well tool from a first operational state to a second operational state.

* * * * *